United States Patent [19]

Parker, Jr. et al.

[11] Patent Number: 4,483,314

[45] Date of Patent: Nov. 20, 1984

[54] COOKING RANGE WITH FIRE EXTINGUISHING FACILITY

[75] Inventors: Charles E. Parker, Jr.; Marshall T. Singleton, both of Washington, N.C.

[73] Assignee: James A. Hackney, III, Washington, N.C.

[21] Appl. No.: 502,607

[22] Filed: Jun. 9, 1983

[51] Int. Cl.[3] ..... F24C 15/10; A62C 7/00

[52] U.S. Cl. ..... 126/221; 169/50; 169/65; 126/25 C; 126/42

[58] Field of Search ..... 126/250, 42, 214 D, 126/221, 220; 169/50, 49, 65; 219/507

[56] References Cited

U.S. PATENT DOCUMENTS 3,049,389 8/1962 Chappellier ..... 169/50

3,630,287 12/1971 Gold ..... 169/65

*Primary Examiner*—Samuel Scott

*Assistant Examiner*—G. Anderson

*Attorney, Agent, or Firm*—Harvey B. Jacobson

[57] ABSTRACT

A kitchen range has a compartment containing a flame-retardant blanket disposed immediately below the heating elements. In one embodiment of the invention, an access opening to the compartment at the front of the range is normally covered by a hinged door. One end of the blanket is releasably secured to the interior of the hinged door. In the event of a fire occurring on one of the heating elements, the door may be opened to expose the blanket, which may be readily withdrawn and draped over the fire. Operating handles may be provided on the front end of the blanket to facilitate its withdrawal and manipulation in a manner protecting a user from the flames. In another embodiment of the invention, the compartment may include a pull-out drawer containing the blanket. The door or drawer may also be used to control a switch for cutting off an energy supply to the range when the door or drawer is opened.

20 Claims, 4 Drawing Figures

FIG. 3
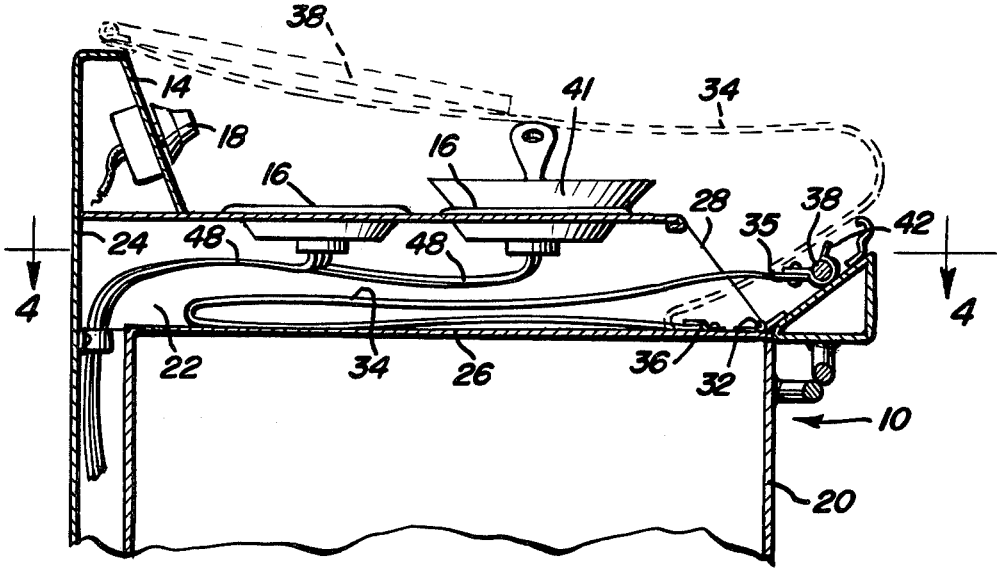
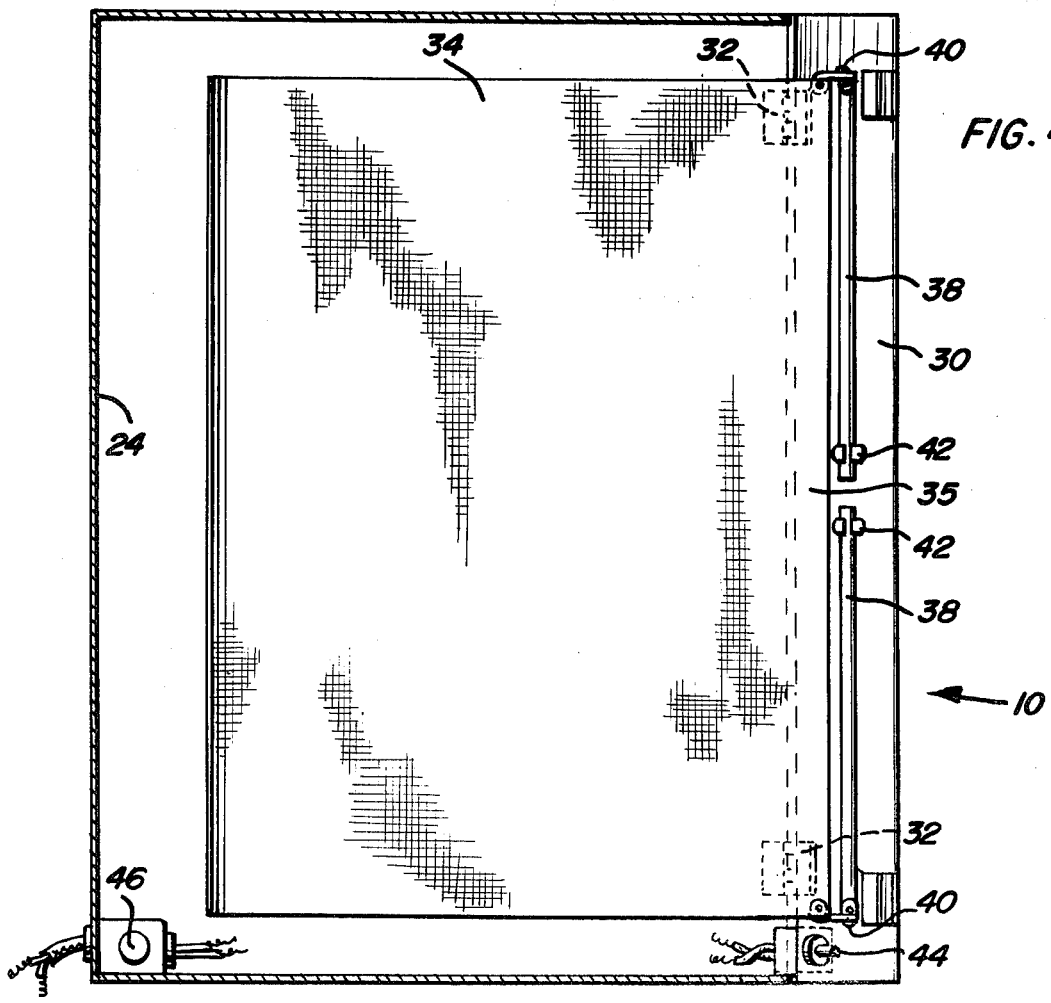
FIG. 4

COOKING RANGE WITH FIRE EXTINGUISHING FACILITY

BACKGROUND OF THE INVENTION

This invention relates to cooking ranges, and more particularly though not exclusively to domestic kitchen ranges.

Many kitchen fires occur because food, commonly grease, ignites on top of a kitchen range. The damage is usually considerably more extensive than necessary because either, there is no fire extinguisher available, or the homemaker uses the wrong extinguishing technique, such as, for example, throwing water on the flames. There are a number of automatic or semi-automatic extinguisher systems available, but these are generally expensive and it is uncommon for a domestic range to be equipped with such a system.

The present invention provides a simple and inexpensive form of fire extinguishing system which may be used on a domestic kitchen range.

DESCRIPTION OF THE PRIOR ART

Applicants are aware of the following prior U.S. Pat. Nos.

2,115,305: F. L. Fox, Apr. 26, 1938,
3,169,517: M. W. Maier, Feb. 16, 1965,
3,434,252: H. F. Dobson, Mar. 25, 1969,
3,630,287: A. S. Gold, Dec, 28, 1971,
3,653,443: W. E. Dockery, Apr. 4, 1972,
3,766,958: N. D. Mitchell, Oct. 23, 1973.

The Dockery patent discloses a fire extinguishing system for a stove or range in which a thermostat controls discharge of fire extinguishing materials and also shuts off electrical power or gas to the range or furnace. The Fox patent discloses a gas stove having a closable lid and a mechanical linkage interconnecting the lid and valves to supply gas to the furnace. The Maier patent discloses an electric stove with a switch mechanism that deenergizes the furnace when a sliding drawer support for the burners is moved outwardly. The Gold patent discloses a fire extinguisher device associated with an oven, which is manually controlled. The Mitchell patent discloses a fire-retardant flexible cover or blanket for a building roof and the Dobson patent discloses a similar protective cover associated with the interior of a window.

SUMMARY OF THE INVENTION

Broadly stated, the invention contemplates the provision of a heat-retardant blanket which is stowed in a blanket receiving compartment associated with the cabinet of a cooking range. Ready access is provided to the stowed blanket for the user of the range so that in the event of a fire occurring on one of the heating elements, the blanket may be readily withdrawn from the compartment and draped over the fire.

The compartment may conveniently have an access opening immediately below the heating elements of the range, and a hinged door may be provided for the access opening. A forward end portion of the blanket stowed in the compartment, may be releasably secured to the interior of the door, so that when the door is opened, in the event of a fire, the forward end of the blanket is exposed to the user. The forward end of the blanket may be the provided with elongated handles to facilitate withdrawal and spreading overe the fire in a manner protecting the user from the flames.

In a further embodiment of the invention, the compartment may include a pull-out drawer, containing the blanket.

In a preferred form of the invention, the door or drawer may be associated with a switch which controls an energy supply to the range, so that when the door or drawer is opened in the event of a fire, the energy supply is terminated. The invention may be applied both to electrical and gas ranges.

The term "blanket" is used herein generically also to include within its scope cloth-like sheets, curtains, blinds and the like.

It will be appreciated from the foregoing that the invention provides a simple and effective means for use in extinguishing range fires. Additional features and advantages of the invention will become apparent from the ensuing description of the preferred embodiment thereof taken in conjunction with the appended claims and attached drawings.

BRIEF DESCRIPTION OF THE DRAWINGS

FIG. 3 is a view similar to FIG. 2 but showing a door to a blanket-receiving compartment in open condition; and FIG. 4 is a sectional view on line 4—4 of FIG. 3.

DESCRIPTION OF THE PREFERRED EMBODIMENT

Figure 1:
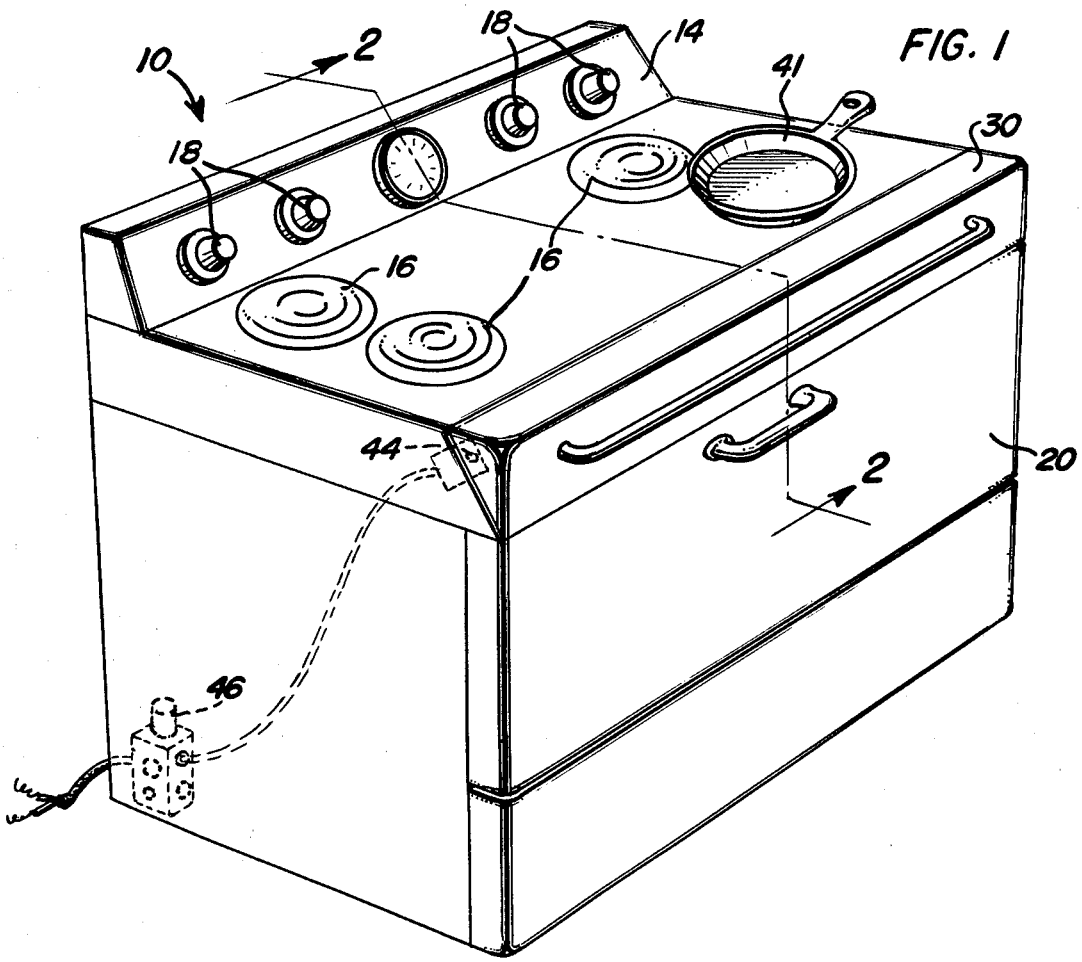
FIG. 1 is a perspective view of a domestic cooking range equipped with apparatus in accordance with the invention.

A domestic cooking range, which may be an electric range or a gas range, comprises a cabinet which is generally indicated by reference 10 in the drawings. The range cabinet 10 has an upper panel 12 on which are carried conventional heating elements 16 that are exposed when cooking thereon. Controls 18 for the cooking elements are arranged, in known manner, at the back of the range on a rear panel 14. The range may have an oven chamber, not shown, and an oven door 20.

Figure 2:
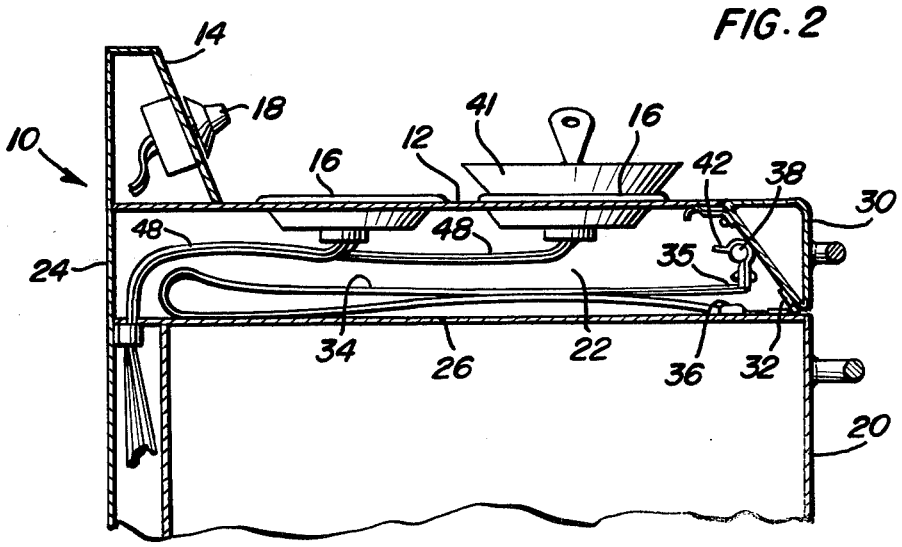
FIG. 2 is a sectional view of the range on line 2—2 of FIG. 1.

As best shown in FIGS. 2 and 3, the cabinet 10 is provided immediately below panel 14 with a blanket receiving compartment 22. The compartment is defined between panel 12, a rear cabinet wall 24, and a lower wall 26. The compartment extends substantially the entire width and depth of the range cabinet. The front of compartment 22 is defined by an access opening 28 (see FIG. 3) and the access opening is provided with a door 30 hinged at 32 to the front of wall 26. The compartment access opening and door 30 extend over substantially the entire width of the range.

A flame-retardant blanket 34 is stowed in compartment 22, in a folded condition, with one end portion 35 of the blanket being releasably secured to the interior of door 30, as will be described, and with the other end portion of the blanket being attached at 36 to wall 26 at a location adjacent the access opening. Any suitable form of attachment means may be used for this purpose.

End portion 35 of the blanket has a pair of elongated handles or rods 38 attached by means of swivel connections 40 or the like (See FIG. 4) to its respective corners. The rods fit releasably in clips 42 on the interior of door 30, thereby forming means for releasably securing end portion 35 of the blanket to the door.

In the event of a fire occurring on one or more of the heating elements, door 30 may be opened to expose end portion 35 of the blanket and rods 38. The rods may be readily released from their clips, and may be swung about swivel connections 40 and drawn laterally outwardly of the stove, to allow the blanket to be withdrawn from its compartment and draped over the fire and over any cooking utensils on the heating elements, (such as pan 41), as shown in dotted line in FIG. 3. The area of the blanket preferably is sufficient to cover the entire upper panel 12 of the range as shown in FIG. 3. In spreading the blanket over the flames, the provision of rods 38, which swing laterally outwardly, allows a user to manipulate the blanket without exposing the user's arms to the fire.

Use of the flame-retardant blanket in the manner described above, allows a fire on one or more of the heating elements to be effectively smothered, whereafter the blanket may be returned to its compartment.

In accordance with an additional feature of the invention, door 30 may also be utilized to control an energy supply to the range. Thus, as seen particularly in FIGS. 1 and 4, the door may be used to operate a switch 44 for controlling the energy supply, through suitable control means such as 46. In the case of an electrical energy supply, for example, the control means 46 may comprise an energizing/deenergizing relay, and in the case of a gas range, the control means 46 may constitute a solenoid-operated gas valve. In either case, switch 44 is adapted to terminate the energy supply to the range through control means 46 when door 30 is opened. Thus, the apparatus provides the facility not only for smothering range fires by use of the blanket 34, but also provides an additional safety factor insofar as the energy supply to the range is terminated when the blanket is exposed. Reference 48 indicates conduits for a supply of energy, either electricity or gas, to the respective heating elements.

Blanket 34 may be made of any suitable material known in the art which will effectively smother flames when used in the described manner.

In an alternative embodiment of the invention, compartment 22 may, for example, contain a pull-out drawer in place of door 30, with blanket 34 contained within the drawer. In this case, the handles at the front end of the blanket may or may not be releasably clipped to the drawer. Again, the drawer may be used to operate a switch corresponding to switch 44. It will be understood that the blanket may be removed from the drawer, and used in the same manner as in the previous embodiment.

While only a preferred embodiment of the invention has been described herein in detail, the invention is not limited thereby and modifications may be made within the scope of the attached claims. For example, the heating element controls 18 may be located on the front of door 30, and the door may also be adapted to operate an alarm when opened. Further, the compartment 22 may be located in different positions.

What is claimed as new is as follows:

1. A cooking range comprising a cabinet provided with at least one heating element adapted to be exposed when cooking thereon, means defining a blanket-receiving compartment associated with the cabinet, a flame-retardant blanket stowed in the compartment, means providing ready access to the stowed blanket for a user of the range whereby, in the event of a fire occurring on said element, the blanket may be withdrawn from the compartment and laid over the fire, at least one elongate handle, and swivel means attaching the handle to the blanket for swinging outward of the handle outwardly of said cabinet when access is provided to the blanket to facilitate withdrawal of the blanket and laying of the blanket over said element.

2. A range as defined in claim 1 wherein said access-providing means comprises an access opening for the compartment and a door associated therewith.

3. A range as defined in claim 2 including means mounting the door for hinged opening and closing movement, and means releasably securing said handle to the interior of the door whereby said said handle is exposed to a user when the door is opened.

4. A range as defined in claim 3 wherein the blanket has a pair of elongate handles at opposite lateral corners respectively, each of the handles being releasaby secured to the interior of the door.

5. A range as defined in claim 3 wherein the blanket is folded in the compartment and the compartment includes means anchoring end portion of the blanket therein adjacent the access opening.

6. A range as defined in claim 2 wherein the range includes an upper panel carrying the heating element, and wherein the access opening and door are disposed immediately beneath the upper panel.

7. A range as defined in claim 6 wherein the access opening and door are disposed at the front of the range.

8. A range as defined in claim 7 wherein the compartment, blanket, access opening and door extend across substantially the entire width of the range, and the blanket has an area sufficient to cover substantially the entire upper panel.

9. A range as defined in claim 8 wherein the upper panel carries plural heating elements.

10. A range as defined in claim 2 including means operable by the door for controlling an energy supply to the range whereby opening of the door effects termination of the energy supply.

11. A cooking range comprising a cabinet provided with at least one heating element adapted to be exposed for cooking thereon, means defining a blanket-receiving compartment associated with the cabinet, the compartment including an access opening and a hinged door for the opening, a flame-retardant blanket stowed in the compartment, and means for releasably securing an end portion of the blanket to the interior of the door, whereby opening of the door exposes said portion of the blanket to a user of the range so as to allow withdrawal and laying of the blanket over said element in the event of a fire.

12. A cooking range as defined in claim 11 wherein the blanket is folded in the compartment and the compartment includes means anchoring the opposite end portion of the blanket therein adjacent the opening.

13. A cooking range defined in claim 12 including switch means operated by the door for controlling an energy supply to the range whereby opening of the door terminates the energy supply.

14. For use in a cooking range having a cabinet provided with at least one heating element adapted to be exposed when cooking thereon, a heat retardant blanket or the like, means intergrating the blanket with the cabinet, means for providing ready access to the blanket by a user of the range whereby, in the event of a fire occurring on said element, the blanket may be laid over the flames to smother the fire and means responsive to utilization of the access providing means for terminating an energy supply to the range.

15. A combination as defined in claim 14 wherein the integrating means comprises means for storing the blanket in stowed condition.

16. A combination as defined in claim 15 wherein the storing means comprises a blanket-receiving compartment.

17. A combination as defined in claim 16 wherein the compartment has a door for providing access to the blanket.

18. A combination as defined in claim 17 including means responsive to opening the door for terminating the energy supply to the range.

19. A combination as defined in claim 16 wherein the compartment comprises a pull-out drawer containing the blanket.

20. A combination as defined in claim 19 including means responsive to opening the drawer for terminating the energy supply to the range.

* * * * *